US005460365A

United States Patent [19]

Payne

[11] Patent Number: 5,460,365

[45] Date of Patent: Oct. 24, 1995

[54] TABLE TENNIS SIDE REBOUND PANEL

[76] Inventor: Edward A. Payne, W. 905 Riverside, #406, Spokane, Wash. 99201

[21] Appl. No.: 140,247

[22] Filed: Oct. 20, 1993

[51] Int. Cl.[6] ..... A63B 67/04

[52] U.S. Cl. ..... 273/30

[58] Field of Search ..... 273/30; 446/111, 446/112, 113; 229/77, 78 A, 105, 106, 107, 113, 114, 116, 117.08, 117.16, 117.24, 914, 125.34, 117.02

[56] References Cited

U.S. PATENT DOCUMENTS

| | | | |
|---|---|---|---|
| 2,066,724 | 1/1936 | Forsyth | 273/30 |
| 2,296,556 | 9/1942 | Junkin | 229/198.1 |
| 2,313,701 | 3/1943 | White | 273/30 |
| 2,688,484 | 9/1954 | Garber | 273/30 |
| 3,428,235 | 2/1969 | Randzzo | 229/40 |
| 3,730,418 | 5/1973 | Spencer | 229/115 |
| 3,891,138 | 6/1975 | Woeste | 229/115 |
| 4,269,348 | 5/1981 | Young | 229/115 |
| 4,979,657 | 12/1990 | Espiritu | 229/198 |

*Primary Examiner*—Theatrice Brown

*Attorney, Agent, or Firm*—Wells, St. John, Roberts, Gregory & Matkin

[57] ABSTRACT

A side rebound panel designed for mounting at both sides of a table tennis table. The panel has a main section against which a ball is rebounded during play. A mounting section is connected by a fold line to the main section. The mounting section includes a base and angled portions which are folded to form laterally stabilizing tubular triangular struts. The mounting section also preferably has a distal portion which mounts a connector to secure the strut construction. Lateral stability sections extend downwardly from the main section to engage the side edges of the table.

19 Claims, 6 Drawing Sheets

TABLE TENNIS SIDE REBOUND PANEL

TECHNICAL FIELD

The technical field of this invention is side rebound panels for table tennis tables.

BACKGROUND OF THE INVENTION

The game of table tennis is familiar to many and involves batting a small resilient ball upon the surface of a table tennis table. Across the middle of the table is a relatively low net. The table tennis ball is batted back and forth over the net. The ball strikes the opponent's side of the table after going over the net. The ball must land on the opponent's side of the table. The opposing player must return the ball before it hits the table a second time or drops to the floor.

The play of table tennis often involves shots which direct the ball to the side, at or near the net. These shots are intentionally difficult to return. However, they lead to a stop in the play. Thus there is a desire by many table tennis players to have longer rallies and fewer interruptions of play.

The current invention improves play by providing side rebound panels which allow laterally directed balls to rebound back toward the table thereby enabling play to continue longer. They also introduce a new dimension and provide additional strategies of play.

BRIEF DESCRIPTION OF THE DRAWINGS

One or more preferred forms of the invention are described herein with reference to the accompanying drawings. The drawings are briefly described below.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Figure 1:
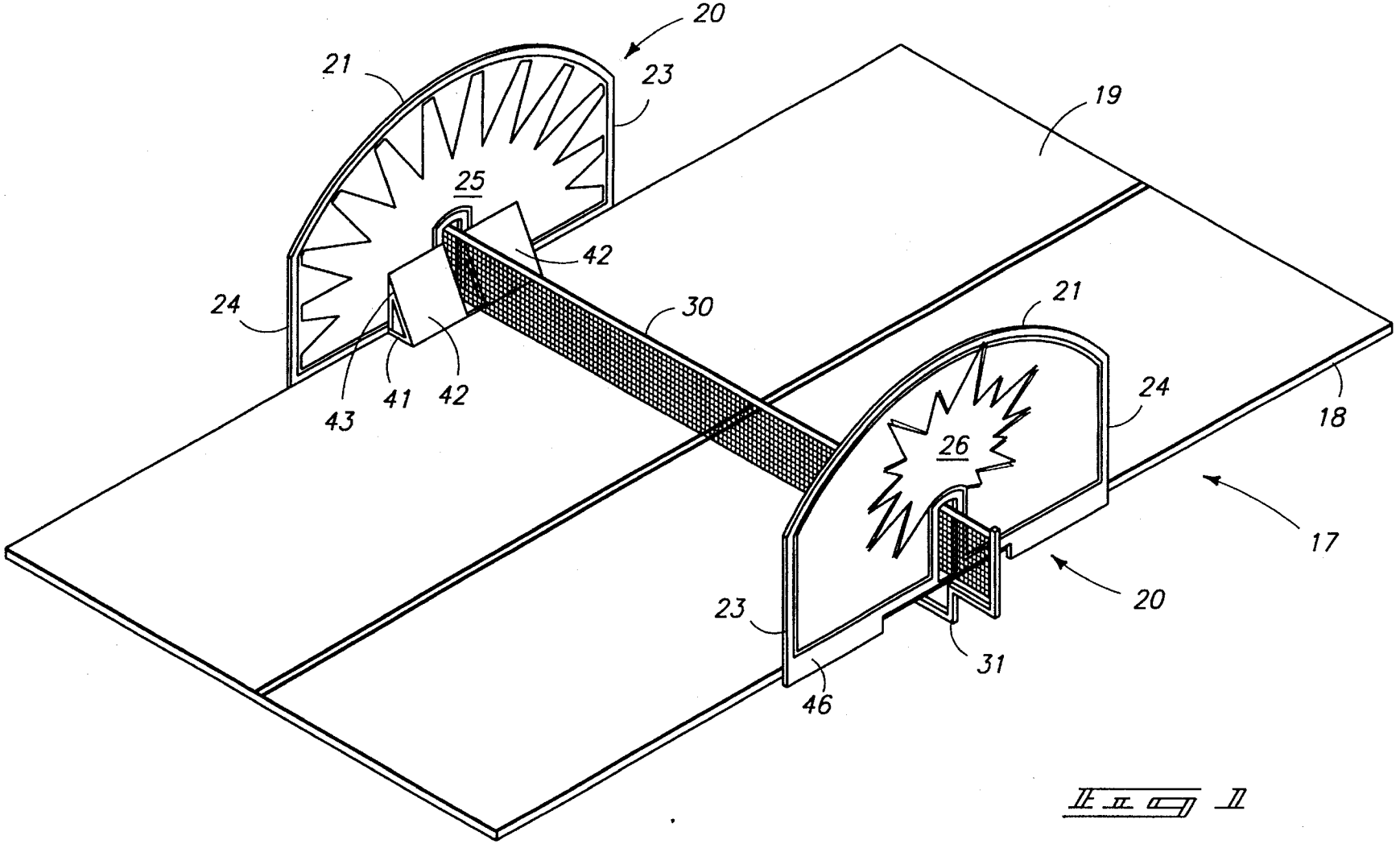
FIG. 1 is a perspective view showing a table tennis table fitted with two preferred side rebound panels according to this invention.

FIG. 1 shows a table tennis table 17 having a top or playing surface 19 and side edges 18. A net 30 extends across the middle of the table and is supported by two opposing net standards 31. The table has also been fitted with two of the novel side rebound panels 20 made in accordance with this invention.

Figure 2:
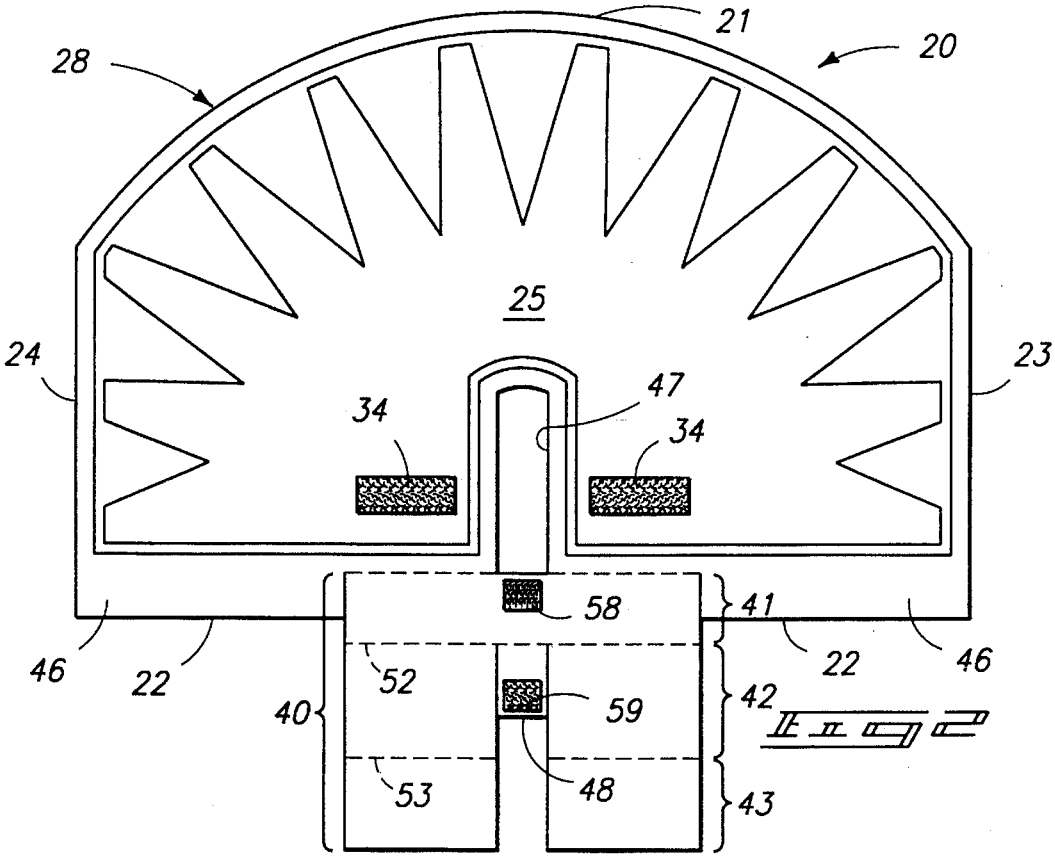
FIG. 2 is a front or inside view of the panels of FIG. 1 shown in a flattened condition.
Figure 3:
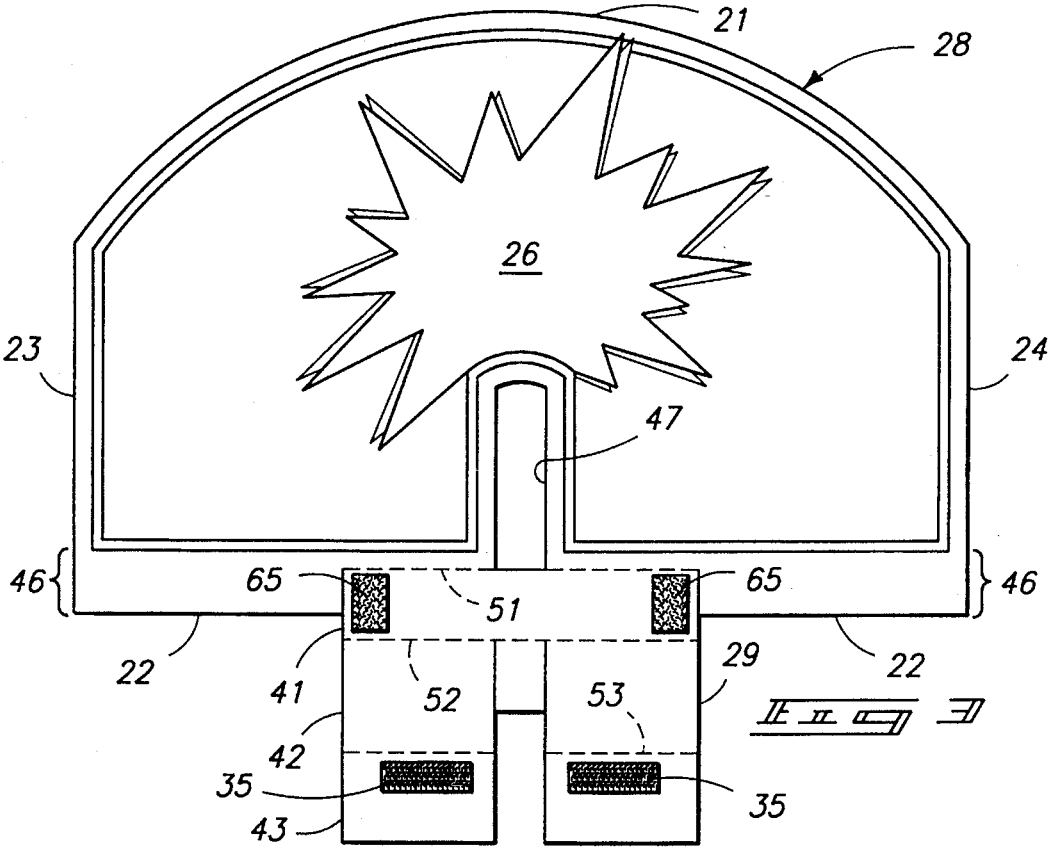
FIG. 3 is a back or outside view of the panels of FIG. 1 shown in a flattened condition.
Figure 4:
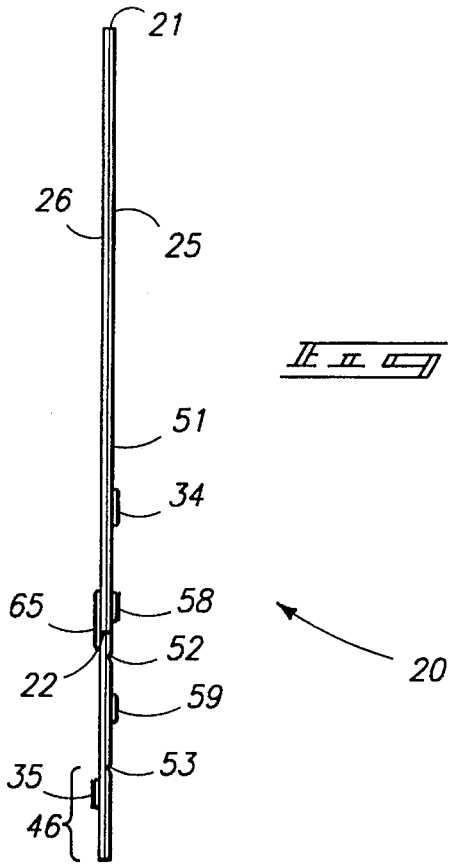
FIG. 4 is a left edge view of the panels of FIG. 1, the right edge view being a mirror image thereof, both shown in a flattened condition.
Figure 5:
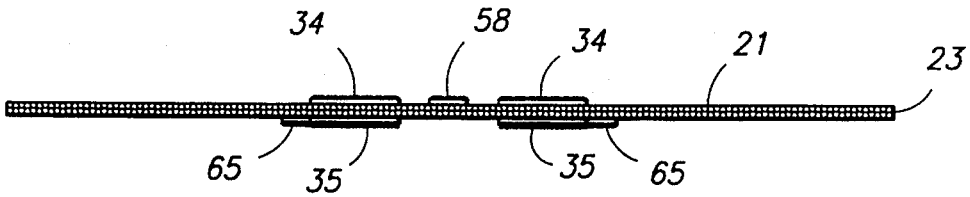
FIG. 5 is a top edge view of the panels of FIG. 1 shown in a flattened condition.
Figure 6:
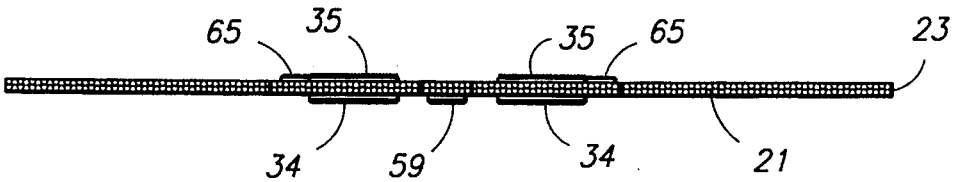
FIG. 6 is a bottom edge view of the panels of FIG. 1 shown in a flattened condition.
Figure 7:
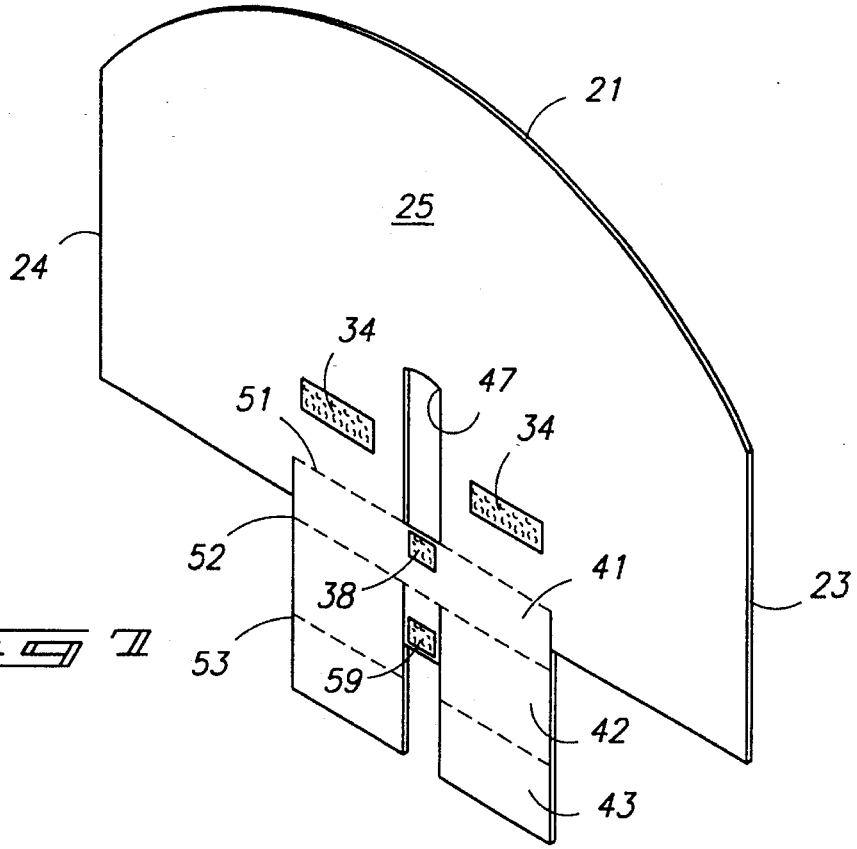
FIG. 7 is a perspective view showing a panels of FIG. 1 in preparation for reconfiguration and mounting to a table tennis table.

FIGS. 2 and 3 show that side rebound panels 20 each have a top edge 21, bottom edges 22, right side edge 23, and left side edge 24. Rebound panels 20 further have an inward or front face 25 and an outward or back face 26. FIGS. 1–3 show preferred ornamental designs on the front and back faces 25 and 26 which have for sake of easy illustration been omitted from the remaining FIGS.

FIGS. 2 and 3 further show that rebound panel 20 includes a main portion or section 28. A mounting section 29 is connected to the main section or part 28 along a first fold line 51. Panel 20 also includes two symmetrically arranged lateral stabilizing sections 46 which are below and to the outside of first fold line 51. A centrally located mounting aperture 47 is also preferably formed through the main part 28 upwardly adjacent to fold line 51. Aperture 47 allows the table tennis net and a suitable net bracket to extend through the rebound panel.

Figure 8:
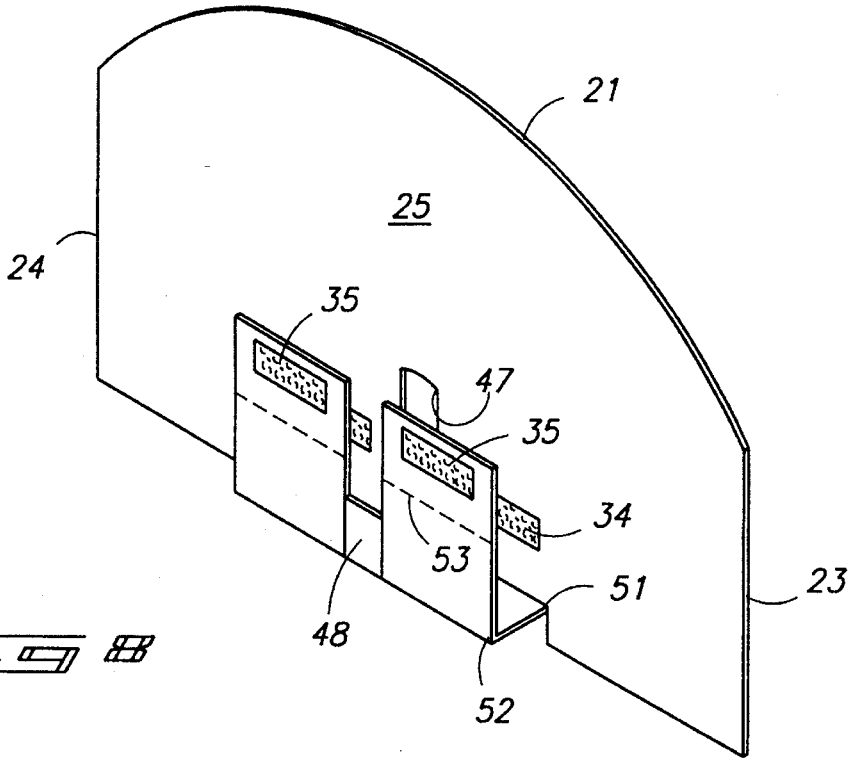
FIG. 8 is a perspective view showing the panel of FIG. 7 partially reconfigured for mounting upon a table tennis table.
Figure 9:
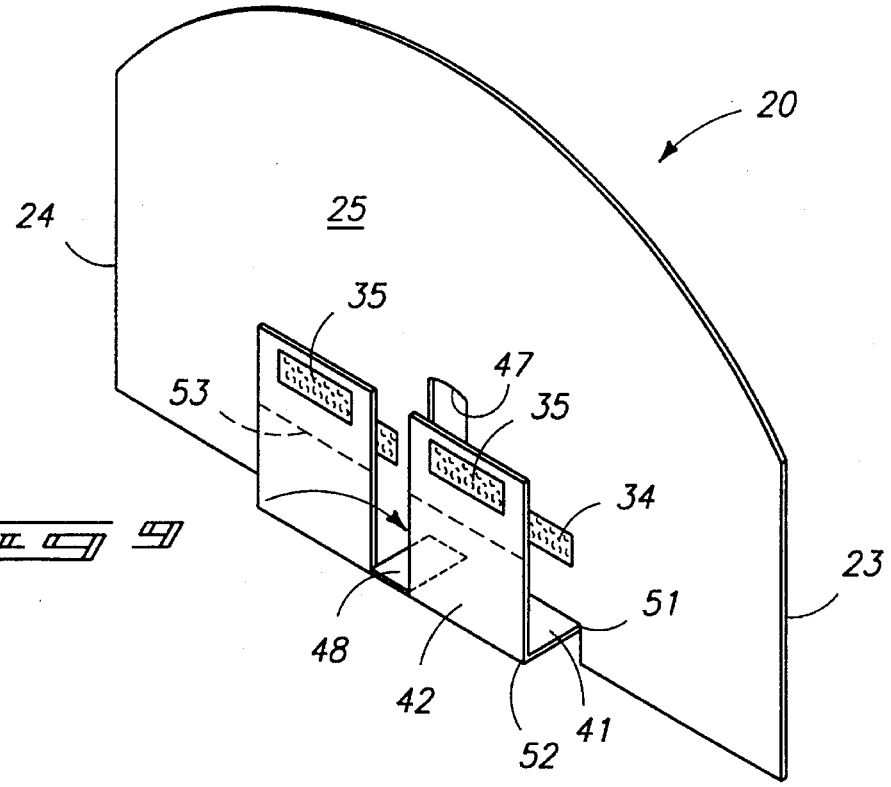
FIG. 9 is a perspective view showing the panel of FIG. 8 in a further stage of being reconfigured for mounting upon a table tennis table.
Figure 10:
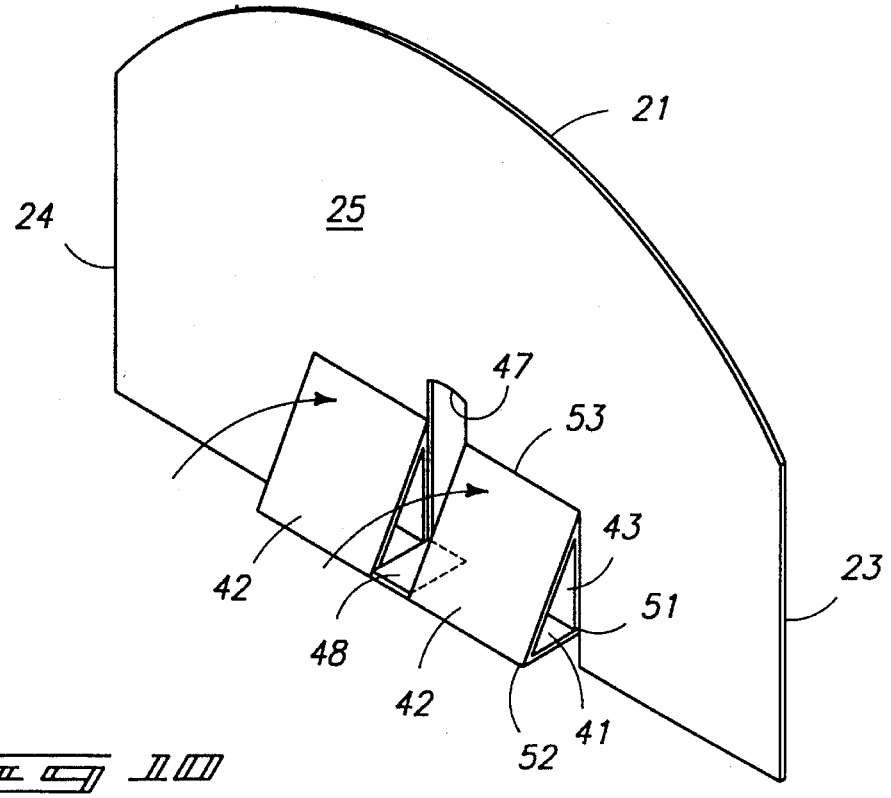
FIG. 10 is a perspective view showing the panel of FIG. 9 in a another stage of being reconfigured for mounting upon a table tennis table.

The mounting section 29 is most preferably integrally connected to the main part of the panel along the first fold line. The mounting section includes a first or base section or sections 41. Base section 41 is reconfigured during mounting to extend approximately perpendicular to the plane of the main section 28, such as shown in FIG. 8. This orientation places the back face of the base section in downward facing contact against the top 19 of the table tennis table. As shown in FIG. 3, the back face of the base section is advantageously provided with positioning connectors 65. Positioning connectors 65 are contact connectors such as the hook and loop type connectors shown. Alternatively, the base-table connectors 65 can be made from adhesive pads, or omitted altogether.

Figure 11:
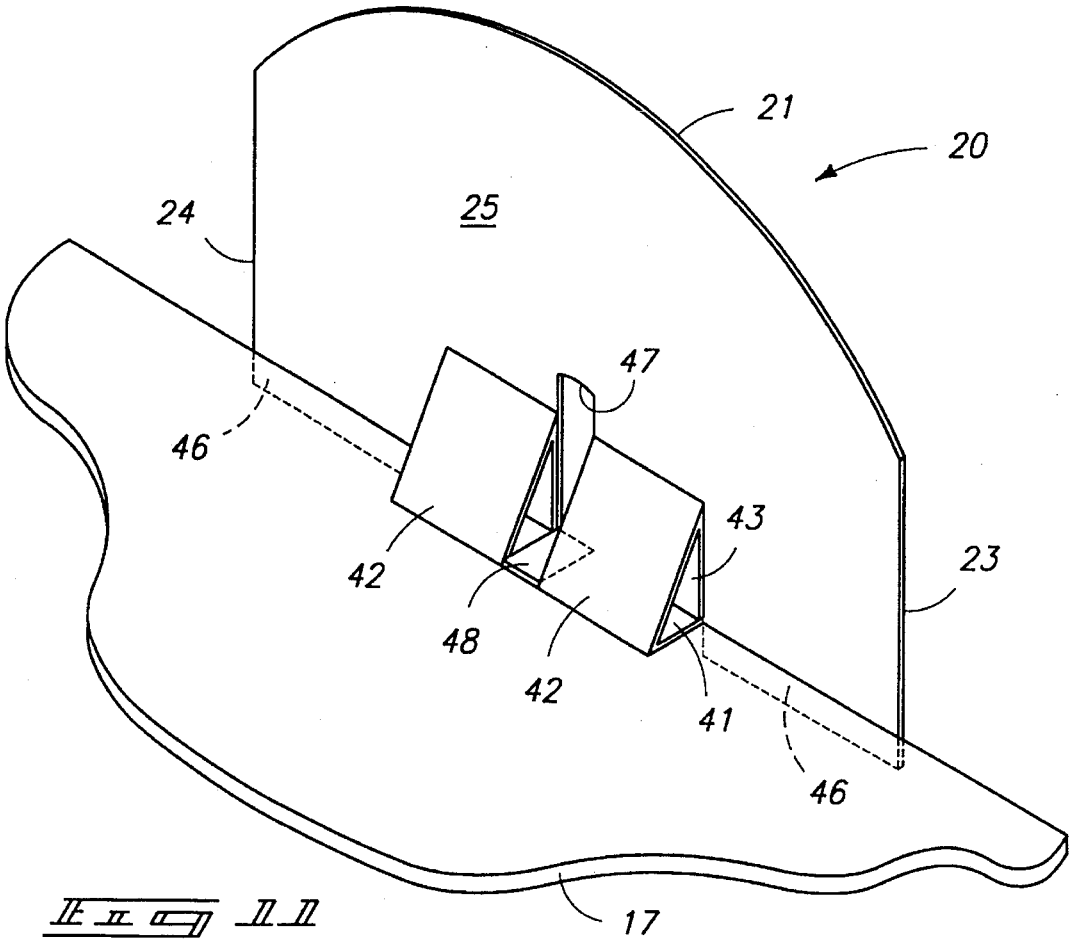
FIG. 11 is a perspective view showing the panel of FIG. 10 in a still further stage of mounting upon a table tennis table.

The mounting section 29 also includes one or more second sections 42. As shown there are two second sections 42 which are angled to form two laterally stabilizing struts, as shown most clearly in FIGS. 11 and 12. Each of second sections 42 are connected to the first or base section 41 along a second fold line 52. The first and second sections of the mounting portion of panel 20 are preferably integrally formed, and integrally connected along second fold lines 52.

The mounting portion 29 of panel 20 further advantageously includes third or distal sections 43. Distal sections 43 are connected to the angled or strut sections 42 along third fold lines 53. The connections between these sections are also preferably integral connections. In the preferred embodiment all portions of the panel are made from a single piece of corrugated cardboard material cut into a planar sheet piece as most clearly depicted in FIGS. 2–6.

The side rebound panels made according to this invention also preferably include a means for connecting the mounting section to the main section. As shown this is advantageously accomplished in the form of strut connectors 34 and 35. The strut connectors are contact type connectors, most preferably detachable hook and loop type connectors having, complementary first parts 34 which mate to second parts 35. First Strut connector parts 34 are glued or otherwise affixed to the main portion of the panel along the inward or front face 25. The second parts 35 of the strut connectors are glued or otherwise affixed to the outward or back face of the distal sections 43. When the mounting part 29 is reconfigured into triangular tubular boxes as shown in FIGS. 7–11, the first and second strut connectors come into face-to-face relationship and serve to maintain the resulting triangular strut formation.

As shown panel 20 also advantageously includes a reinforcing flap 48. Reinforcing flap 48 is connected to the first or base section 41, such as along the second fold line 52. Reinforcing flap 48 is divided from the adjacent second or strut sections 42 by cuts formed in the sheet piece as indicated. Upon installation the reinforcing flap 48 is folded over onto the base, as shown most clearly in FIG. 9. A detachable reinforcing flap connector formed by first and second parts 58 and 59 are preferably included to assist in holding the reinforcing flap in the folded over position. Reinforcing flap connector parts 58 and 59 are preferably complementary hook and loop type connection parts glued or otherwise affixed to the front surfaces of the central region of base section 41 and to reinforcing flap 48, respectively.

The panels 20 are preferably made by selecting a suitable sheet material, such as corrugated paper cardboard. The sheet material is made sufficiently thick to provide the desired rigidity, for example approximately 2–4 millimeters thick. The cardboard is then cut into the shape indicated and fold lines can be embossed into the resulting panel to facilitate easy reconfiguration during mounting upon a table tennis table. Smooth paper overlays are advantageously applied to the front and back surfaces of the main part 28 to provide a smooth surface and aesthetically pleasing appearance. The designs shown in FIGS. 1–3 also help to provide visual discrimination against walls, floors or other background objects.

The panels 20 are used by reconfiguring the mounting portion 29 as illustrated in FIGS. 7–11. More specifically, the base section 41 is folded about the first fold line 51 .to become approximately perpendicular to the main portion 28. The strut sections 42 and distal sections 43 are then folded over to form triangular tubular struts and secured to the main part of the panel by engaging the complementary strut connection parts 34 and 35. The reinforcing tab is also folded over and secured by engaging the complementary connection parts 58 and 59. The resulting reconfigured panel is set along the central side of the table tennis table 17 as shown in FIG. 1.

Figure 12:
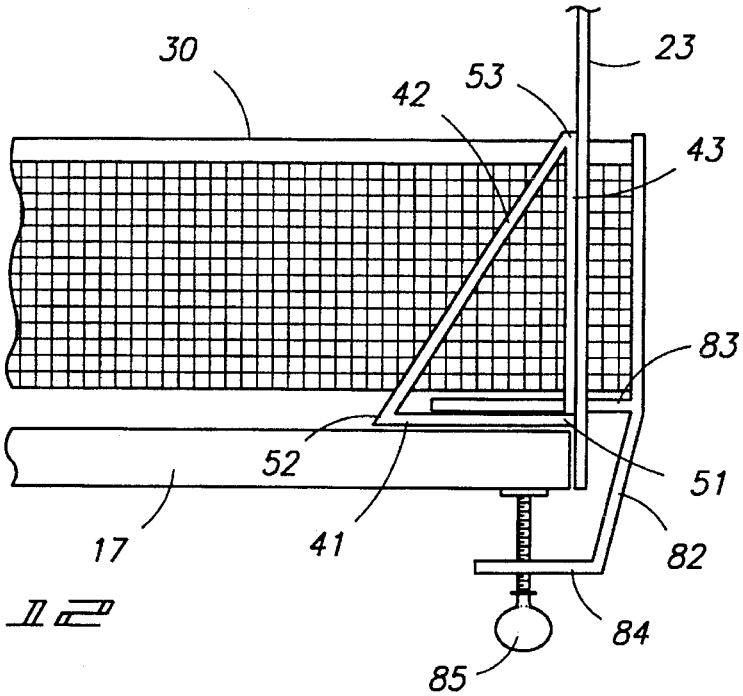
FIG. 12 is a partial elevational view showing the panel of FIGS. 7–11 mounted upon a table and in-part secured using a table tennis net standard or mounting bracket.

Depending upon the style of net standard used, the standard can be used to help hold the reconfigured panel in position upon the table. FIG. 12 shows a preferred installation in which the net standards are in the form of a bracket 82 having upper and lower clamping arms 83 and 84. The upper clamp arm extends inwardly over the reinforcing flap 48 and underlying base 41. The clamping screw 85 is then tightened to hold both the net standard and side rebound panel in position. Alternatively or additionally, the base-table connectors 65 can be mated with complementary connectors affixed to the top surface of the table (not shown) to hold the panel in position. Another alternative is to bolt or glue the panels to the side of the table. This may be necessary with net standards which extend from below the table, such as shown in FIG. 1.

In compliance with the statute, the invention has been described in language necessarily limited in its ability to properly convey the conceptual nature of the invention. Because of this inherent limitation of language, it must be understood that the invention is not necessarily limited to the specific features described, since the means herein disclosed comprise merely preferred forms of putting the invention into effect. The invention is, therefore, claimed in any of its forms or modifications within the proper scope of the appended claims appropriately interpreted in accordance with the doctrine of equivalents.

I claim:

1. A table tennis ball rebound device comprising:

a main section joined by at least one fold line to at least one mounting section; said mounting section being foldable to reconfigure the mounting section and provide stabilization of the rebound device when mounted to a table tennis table;

at least one lateral stability section extending from said main section for engaging a side edge surface of a table tennis table when the rebound device is mounted thereon said rebound device being constructed from a sheet of material foldable into a substantially planar configuration.

2. A table tennis ball rebound device in accordance with claim 1 and further comprising a mounting aperture extending through the main section.

3. A table tennis ball rebound device in accordance with claim 1 wherein said mounting section includes:

a base section connected to said main section along said at least one fold line;

at least one strut section connected to said base section and extending at an angular orientation from at least one second fold line to the main section to provide lateral stability for the main section;

at least one distal section connected to said at least one strut section along at least one third fold line; said at least one distal section being detachably connected to the main section; and at least one connector for connecting said distal section to said main section to hold said strut section at said angular orientation.

4. A table tennis ball rebound device in accordance with claim 1 wherein said mounting section includes a plurality of strut sections.

5. A table tennis ball rebound device in accordance with claim 1 wherein said mounting section includes:

at least one base section connected to said main section;

at least one strut section connected to said base section and extending at an angular orientation from the base section to the main section to provide lateral stability for the main section.

6. A table tennis ball rebound device in accordance with claim 1 wherein said mounting section includes:

a base section connected to said main section along said at least one fold line;

at least one strut section connected to said base section and extending at an angular orientation from the base section to the main section to provide lateral stability for the main section.

7. A table tennis ball rebound device in accordance with claim 1 wherein said mounting section includes:

a base section connected to said main section along said at least one fold line;

at least one strut section connected to said base section and extending at an angular orientation from the base section to the main section to provide lateral stability for the main section;

at least one distal section connected to said at least one strut section, said at least one distal section being connected to the main section;

and at least one connector spaced from said at least one fold line and connecting the main section to the distal section.

8. A table tennis ball rebound device in accordance with claim 1 wherein said mounting section includes:

a base section connected to said main section along said at least one fold line;

at least one strut section connected to said base section along at least one second fold line; said at least one strut section extending at an angular orientation from said at least one second fold line to the main section to provide lateral stability for the main section; and at least one connector connecting said strut section to said main section at a position spaced from said at least one fold line.

9. A table tennis ball rebound device in accordance with claim 1 wherein said mounting section includes:

a base section connected to said main section along said at least one fold line;

at least one strut section connected to said base section along at least one second fold line; said at least one strut section extending at an orientation from said at least one second fold line to the main section to provide lateral stability for the main section;

at least one distal section connected to said at least one strut section along at least one third fold line; said at least one distal section being detachably connected to the main section; and at least one connector for detachably connecting said distal section to said main section to hold said strut section at said angular orientation.

10. A table tennis ball rebound device in accordance with claim 1 wherein said mounting section includes:

a base section connected to said main section along said at least one fold line;

at least one strut section connected to said base section along at least one second fold line; said at least one strut section extending at an angular orientation from said at least one second fold line to the main section to provide lateral stability for the main section;

at least one distal section connected to said at least one strut section along at least one third fold line; said at least one distal section being detachably connected to the main section; and at least one connector for connecting said at least one distal section to said main section at a position spaced from said at least one fold line; said connector being a detachable hook and loop contact connector.

11. A table tennis ball rebound device, comprising:

a main section, at least one mounting section connected to said main section along at least one first fold line; said at least one mounting section comprising:

at least one base section connected to said main section along said at least one first fold line;

at least one strut section connected to said base section along at least one second fold line; said at least one strut section extending at an angular orientation from said at least one second fold line to the main section to provide lateral stability for the main section;

at least one distal section connected to said at least one strut section along at least one third fold line; said at least one distal section being detachably connected to the main section;

lateral stability sections extending from said main section for engaging side edge surfaces of a table tennis table when the rebound panel is mounted thereon; and at least one connector for connecting said at least one distal section to said main section at a position spaced from said at least one fold line said rebound device being constructed from an integral sheet of material foldable into a substantially planar configuration.

12. A table tennis ball rebound device in accordance with claim 11 wherein said at least one connector is a detachable contact connector.

13. A table tennis ball rebound device in accordance with claim 11 wherein said at least one connector is a detachable hook and loop contact connector.

14. A table tennis ball rebound device in accordance with claim 11 and further comprising a mounting aperture extending through the main section.

15. A table tennis ball rebound device in accordance with claim 11 and further comprising a reinforcement flap connected to said at least one base section.

16. A table tennis ball rebound device, comprising:

a main section;

a mounting aperture extending through the main section;

at least one mounting section connected to said main section along at least one first fold line; said at least one mounting section comprising:

at least one base section connected to said main section along said at least one first fold line;

at least one strut section connected to said base section along at least one second fold line; said at least one strut section extending at an angular orientation from said at least one second fold line to the main section to provide lateral stability for the main section;

at least one distal section connected to said at least one strut section along at least one third fold line; said at least one distal section being connected to the main section;

lateral stability sections extending from said main section for engaging a side edge surface of a table tennis table when the rebound panel is mounted thereon; and at least one connector for connecting said at least one distal section to said main section at a position spaced from said at least one fold line.

17. A table tennis ball rebound device in accordance with claim 16 wherein said at least one connector is a detachable contact connector.

18. A table tennis ball rebound device in accordance with claim 16 wherein said at least one connector is a detachable hook and loop contact connector.

19. A table tennis ball rebound device in accordance with claim 16 and further comprising a reinforcement flap connected to said at least one base section.

* * * * *